US011067911B2

(12) United States Patent
Yamada

(10) Patent No.: US 11,067,911 B2
(45) Date of Patent: Jul. 20, 2021

(54) DISPERSANT-ATTACHED POLYTETRAFLUOROETHYLENE PARTICLE, COMPOSITION, LAYER-SHAPED ARTICLE, ELECTROPHOTOGRAPHIC PHOTORECEPTOR, PROCESS CARTRIDGE, AND IMAGE FORMING APPARATUS

(71) Applicant: FUJIFILM Business Innovations Corp., Tokyo (JP)

(72) Inventor: Wataru Yamada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/275,790

(22) Filed: Feb. 14, 2019

(65) Prior Publication Data

US 2020/0096887 A1 Mar. 26, 2020

(30) Foreign Application Priority Data

Sep. 26, 2018 (JP) ..... JP2018-180858

(51) Int. Cl.
*G03G 5/147* (2006.01)
*G03G 15/00* (2006.01)
*G03G 21/18* (2006.01)

(52) U.S. Cl.
CPC ..... *G03G 5/14726* (2013.01); *G03G 5/14795* (2013.01); *G03G 15/75* (2013.01); *G03G 21/1803* (2013.01)

(58) Field of Classification Search
CPC ..... G03G 5/14726; G03G 5/14795; G03G 15/75; G03G 21/1803; G03G 5/14734; G03G 5/1473; G03G 5/0542; G03G 5/0546; G03G 5/0539; G03G 2215/00957; G03G 5/0596; G03G 5/1726
See application file for complete search history.

(56) References Cited

U.S. PATENT DOCUMENTS

| | | | | |
|---|---|---|---|---|
| 5,637,142 | A | 6/1997 | Kubo et al. | |
| 6,303,254 | B1 * | 10/2001 | Yu | G03G 5/10 430/56 |
| 7,553,594 | B2 | 6/2009 | Ogaki et al. | |
| 7,838,190 | B2 | 11/2010 | Ogaki et al. | |
| 2007/0056359 | A1 * | 3/2007 | Ng | G01N 5/04 73/61.72 |
| 2007/0292794 | A1 * | 12/2007 | Chen | G03G 5/14726 430/59.6 |
| 2009/0060574 | A1 * | 3/2009 | Shibata | G03G 21/08 399/128 |
| 2013/0252152 | A1 * | 9/2013 | Kawabata | G03G 15/00 430/56 |

FOREIGN PATENT DOCUMENTS

| | | | |
|---|---|---|---|
| JP | 4251662 | B2 | 4/2009 |
| JP | 2009-104145 | A | 5/2009 |
| JP | 2017-090566 | A | 5/2017 |

* cited by examiner

*Primary Examiner* — Peter L Vajda
(74) *Attorney, Agent, or Firm* — Sughrue Mion, PLLC

(57) ABSTRACT

A dispersant-attached polytetrafluoroethylene particle includes a polytetrafluoroethylene particle; and a dispersant that contains a fluorine atom and is attached to a surface of the polytetrafluoroethylene particle. The dispersant-attached polytetrafluoroethylene particle has a particle size distribution index [$D_{50}$-$D_{10}$] of 50 nm or more.

20 Claims, 3 Drawing Sheets

DISPERSANT-ATTACHED POLYTETRAFLUOROETHYLENE PARTICLE, COMPOSITION, LAYER-SHAPED ARTICLE, ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2018-180858 filed Sep. 26, 2018.

BACKGROUND

(i) Technical Field

The present disclosure relates to a dispersant-attached polytetrafluoroethylene particle, a composition, a layer-shaped article, an electrophotographic photoreceptor, a process cartridge, and an image forming apparatus.

(ii) Related Art

Polytetrafluoroethylene particles are widely used as, for example, lubricants.

For example, Japanese Unexamined Patent Application Publication No. 2009-104145 discloses an "electrophotographic photoreceptor that includes a photosensitive layer containing fluorine atom-containing resin particles. Japanese Unexamined Patent Application Publication No. 2009-104145 also discloses polytetrafluoroethylene particles as the fluorine atom-containing resin particles.

Japanese Unexamined Patent Application Publication No. 2017-090566 discloses an "electrophotographic photoreceptor that includes a photosensitive layer containing a surfactant and a binder resin, in which the surfactant content relative to 100.00 parts by mass of the binder resin is 0.10 parts by mass or more and 3.00 parts by mass or less, the hydrophobic group in the surfactant is a perfluoroalkyl group, and the surfactant is nonionic".

SUMMARY

Polytetrafluoroethylene particles (hereinafter may be referred to as "PTFE particles") are mixed with a fluorine atom-containing dispersant (hereinafter may be referred to as a "fluorine-containing dispersant") together with, for example, components such as a dispersion medium and powder. However, when the state of the components mixed together changes (for example, changes such as evaporation of the dispersion medium and melting of the powder), the dispersibility of the polytetrafluoroethylene particles tends to be degraded.

Aspects of non-limiting embodiments of the present disclosure relate to a dispersant-attached polytetrafluoroethylene particle having excellent dispersibility compared to when the particle size distribution index [$D_{50}$-$D_{10}$] is less than 50 nm.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a dispersant-attached polytetrafluoroethylene particle including a polytetrafluoroethylene particle and a dispersant that contains a fluorine atom and is attached to a surface of the polytetrafluoroethylene particle. The dispersant-attached polytetrafluoroethylene particle has a particle size distribution index [$D_{50}$-$D_{10}$] of 50 nm or more.

BRIEF DESCRIPTION OF THE DRAWINGS

Exemplary embodiments of the present disclosure will be described in detail based on the following figures, wherein.

DETAILED DESCRIPTION

Figure 1:
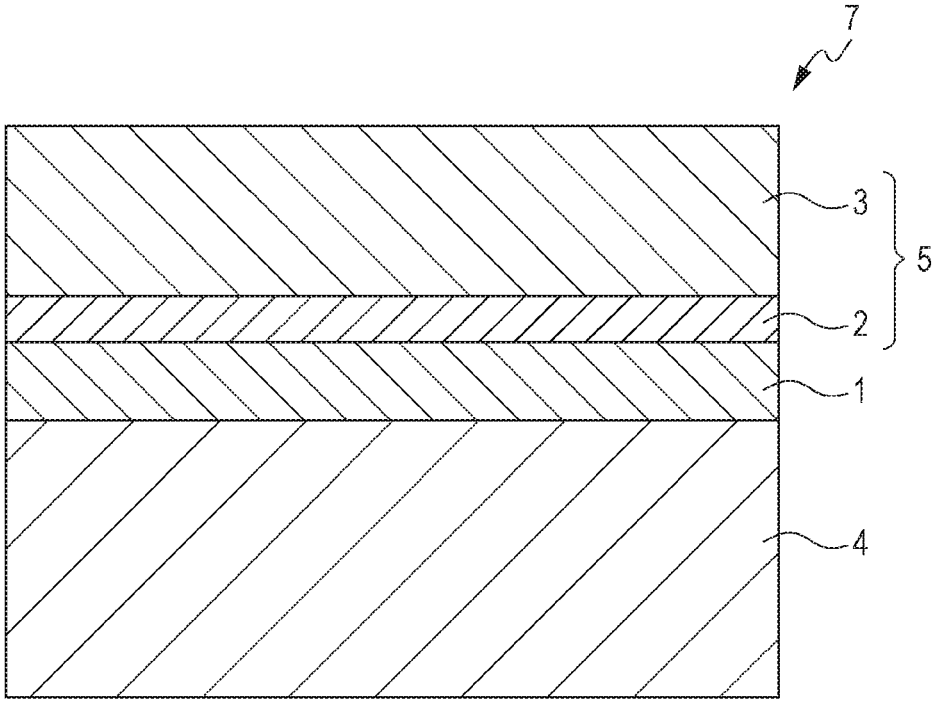
FIG. 1 is a schematic cross-sectional view of one example of the layer structure of an electrophotographic photoreceptor of an exemplary embodiment.

An exemplary embodiment, which is one example of the present disclosure, will now be described in detail.

(Dispersant-Attached Polytetrafluoroethylene Particles)

Dispersant-attached polytetrafluoroethylene particles (dispersant-attached PTFE particles) of this exemplary embodiment include PTFE particles and a dispersant having a fluorine atom (fluorine-containing dispersant), and at least part of the fluorine-containing dispersant is attached to surfaces of the PTFE particles.

The dispersant-attached PTFE particles of this exemplary embodiment have a particle size distribution index [$D_{50}$-$D_{10}$] of 50 nm or more.

The dispersant-attached PTFE particles of this exemplary embodiment have excellent dispersibility due to the above-described feature. The reason behind this is presumably as follows.

Typically, PTFE particles are mixed with a fluorine-containing dispersant together with, for example, components such as a dispersion medium and powder. However, when the state of the components mixed together changes (for example, changes such as evaporation of the dispersion medium and melting of the powder), the dispersibility of the polytetrafluoroethylene particles tends to be degraded.

Specifically, for example, when a layer-shaped article containing PTFE particles is to be formed by using a liquid composition (for example layer-forming coating solution or the like) containing PTFE particles, a fluorine-containing dispersant, a resin, and a dispersion medium, the dispersion medium is dried during the process of forming the layer-shaped article. During the process of drying (in other words, evaporating) the dispersion medium, the dispersibility of the PTFE particles may become degraded, and agglomeration of the PTFE particles may occur.

In addition, for example, when a layer-shaped article containing PTFE particles is to be formed by using a solid composition (for example, a powder coating material or the like) containing PTFE particles, a fluorine-containing dispersant, and resin particles, the resin is melted during the process of forming the layer-shaped article. During the process of melting the resin, the dispersibility of the PTFE particles may become degraded, and agglomeration of the PTFE particles may occur.

As a result, a layer-shaped article with degraded PTFE particle dispersibility is formed.

In contrast, the dispersant-attached PTFE particle of this exemplary embodiment has a particle diameter such that the particle size distribution index [$D_{50}$-$D_{10}$], which is the difference between the particle diameter $D_{50}$ at 50% in the cumulative distribution from the small diameter size and the particle diameter $D_{10}$ at 10%, is within the aforementioned range. In other words, a large quantity of dispersant-attached PTFE particles with small particle diameters are contained. Thus, dispersant-attached PTFE particles having small diameters (small particles) attach around dispersant-attached PTFE particles having large diameters (large particles), agglomeration of the large particles is thereby suppressed, and the increase in particle diameter (secondary particle diameter) is suppressed even if agglomerated particles are formed. As a result, even after agglomeration, degradation of the dispersibility of the dispersant-attached PTFE particles is suppressed.

In view of the above, it is assumed that the dispersant-attached PTFE particle of this exemplary embodiment exhibits excellent dispersibility even when the state of the components mixed is changed.

The dispersant-attached PTFE particles of this exemplary embodiment will now be described in detail.

Particle Size Distribution Index [$D_{50}$-$D_{10}$]

The dispersant-attached PTFE particle of this exemplary embodiment has a particle size distribution index [$D_{50}$-$D_{10}$] of 50 nm or more, preferably 50 nm or more and 200 nm or less, more preferably 60 nm or more and 150 nm or less, and yet more preferably 70 nm or more and 100 nm or less.

A particle size distribution index [$D_{50}$-$D_{10}$] of 50 nm or more indicates that a large quantity of particles having small diameters are contained, and as a result, dispersant-attached PTFE particles having excellent dispersibility are obtained.

The method for controlling the particle size distribution index [$D_{50}$-$D_{10}$] within the aforementioned range may be any, and examples of the method include a method that uses PTFE particles having a wide particle size distribution and a method that uses a mixture of two or more types of PTFE particles having average particle diameters significantly different from one another but each having a narrow particle size distribution.

PTFE particles produced by a production method that includes a disintegrating step or a pulverizing step tend to exhibit a wide particle size distribution. For example, PTFE particles obtained by a production method that includes a disintegrating step after forming large particles by polymerization tend to exhibit a wide particle size distribution. In contrast, PTFE particles having a narrow particle size distribution can be produced by emulsification polymerization in which the type and amount of the emulsifier etc., are controlled.

Super-Small-Diameter-Side Particle Size Distribution Index [$D_5$]

The dispersant-attached PTFE particle of this exemplary embodiment preferably has a super-small-diameter-side particle size distribution index [$D_5$] of 50 nm or more, more preferably 50 nm or more and 300 nm or less, yet more preferably 100 nm or more and 250 nm or less, and still more preferably 150 nm or more and 200 nm or less.

A super-small-diameter-side particle size distribution index [$D_5$] of 50 nm or more indicates that the quantity of particles having small particle diameters is reduced, and due to this feature, the probability that the dispersant attaches to small-diameter-side particles that do not have to have the dispersant attached is decreased, and the dispersant can be efficiently attached to the large-diameter-side particles to which the dispersant is to be attached. Thus, manufacturability of the dispersant-attached PTFE particles is improved.

The method for controlling the super-small-diameter-side particle size distribution index [$D_5$] within the aforementioned range may be any. For example, the PTFE particles may be washed before, after, or before and after the fluorine-containing dispersant is attached to the particles.

Specifically, for example, the PTFE particles may be washed with pure water, alkaline water, an alcohol (methanol, ethanol, isopropanol, or the like), a ketone (acetone, methyl ethyl ketone, methyl isobutyl ketone, or the like), an ester (ethyl acetate or the like), and any other common organic solvent (toluene, tetrahydrofuran, or the like). In particular, the PTFE particles may be washed with an organic solvent (at least one of toluene and tetrahydrofuran).

Washing may be performed at room temperature (for example, 22° C.) or under heating.

Average Primary Particle Diameter

The dispersant-attached PTFE particles of the exemplary embodiment preferably have an average primary particle diameter of 0.1 μm or more and 1 μm or less and more preferably 0.15 μm or more and 0.5 μm or less.

When the average primary particle diameter is 0.1 μm or more and 1 μm or less, dispersant-attached PTFE particles having excellent dispersibility are easily obtained.

The method for controlling the average primary particle diameter within the aforementioned range may be any, and examples thereof include adjusting the disintegration conditions and adjusting the molecular weight of the PTFE particles used.

The methods for measuring the particle size distribution index [$D_{50}$-$D_{10}$], the super-small-diameter-side particle size distribution index [$D_5$], and the average primary particle diameter will now be described.

The dispersant-attached PTFE particles to be measured (for example, a layer-shaped article containing dispersant-attached PTFE particles) is observed with a scanning electron microscope (SEM) to take an image at 5000 or higher magnification, for example. Two hundred particles are extracted from the obtained image at random, and the maximum diameter of each of the dispersant-attached PTFE particles (primary particles) is measured.

A cumulative distribution is plotted from the small diameter side on the basis of the maximum diameters of the two hundred particles measured, and the particle diameter at 5% in the cumulative distribution is defined as the particle diameter $D_5$, the particle diameter at 10% is defined as the particle diameter $D_{10}$, and the particle diameter at 50% is defined as the particle diameter $D_{50}$. The particle diameter $D_5$ is the super-small-diameter-side particle size distribution index [$D_5$]. These results are used to calculate the particle size distribution index [$D_{50}$-$D_{10}$]. Furthermore, the number-average (arithmetic mean) particle diameter of all two hundreds particles measured is the average primary particle diameter.

The SEM used is JSM-6700F produced by JEOL Ltd., and a secondary electron image at an accelerating voltage of 5 kV is observed.

Polytetrafluoroethylene Particles (PTFE Particles)

The PTFE particles (PTFE particles onto which a fluorine-containing dispersant is not attached) contained in the dispersant-attached PTFE particles of the exemplary embodiment are particles of a compound having a structure represented by "$(—CF_2—CF_2—)_n$".

The specific surface area (BET specific surface area) of the PTFE particles is preferably 5 $m^2/g$ or more and 15 $m^2/g$ or less and more preferably 7 $m^2/g$ or more and 13 $m^2/g$ or less from the viewpoint of dispersion stability.

The specific surface area is a value measured by a BET-type specific surface area meter (FlowSorb II2300 produced by Shimadzu Corporation) by a nitrogen substitution method.

The apparent density of the PTFE particles is preferably 0.2 g/ml or more and 0.5 g/ml or less and more preferably 0.3 g/ml or more and 0.45 g/ml or less from the viewpoint of dispersion stability.

The apparent density is a value measured in accordance with JIS K 6891 (1995).

The melting temperature of the PTFE particles is preferably 300° C. or higher and 340° C. or lower, and more preferably 325° C. or higher and 335° C. or lower.

The melting temperature is a melting point measured in accordance with JIS K 6891 (1995).

Dispersant Containing Fluorine Atom (Fluorine-Containing Dispersant)

The fluorine-containing dispersant contains at least a fluorine atom in the molecular structure.

Examples of the fluorine-containing dispersant include polymers obtained by homopolymerization or copolymerization of polymerizable compounds having fluorinated alkyl groups (hereinafter these polymers may be referred to as "fluorinated alkyl group-containing polymers").

Specific examples of the fluorine-containing dispersant include homopolymers of (meth)acrylates having fluorinated alkyl groups, and random or block copolymers obtained from (meth)acrylates having fluorinated alkyl groups and fluorine atom-free monomers. Note that (meth) acrylates refer to both acrylates and methacrylates.

Examples of the (meth)acrylates having fluorinated alkyl groups include 2,2,2-trifluoroethyl (meth)acrylate and 2,2,3,3,3-pentafluoropropyl (meth)acrylate.

Examples of the fluorine atom-free monomers include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth) acrylate, 2-methoxyethyl (meth)acrylate, methoxytriethylene glycol (meth)acrylate, 2-ethoxyethyl (meth)acrylate, tetrahydrofurfuryl (meth)acrylate, benzyl (meth)acrylate, ethylcarbitol (meth)acrylate, phenoxyethyl (meth)acrylate, 2-hydroxy (meth)acrylate, 2-hydroxypropyl (meth)acrylate, 4-hydroxybutyl (meth)acrylate, methoxypolyethylene glycol (meth)acrylate, methoxypolyethylene glycol (meth)acrylate, phenoxypolyethylene glycol (meth)acrylate, hydroxyethyl-o-phenylphenol (meth)acrylate, and o-phenylphenol glycidyl ether (meth)acrylate.

Other specific examples of the fluorine-containing dispersant include block or branched polymers disclosed in the U.S. Pat. No. 5,637,142 and Japanese Patent No. 4251662. Other specific examples of the fluorine-containing dispersant include fluorine-based surfactants.

Among these, a fluorinated alkyl group-containing polymer having a structural unit represented by general formula (FA) below is preferred, and a fluorinated alkyl group-containing polymer having a structural unit represented by general formula (FA) below and a structural unit represented by general formula (FB) below is more preferred.

In the description below, the fluorinated alkyl group-containing polymer having a structural unit represented by general formula (FA) below and a structural unit represented by general formula (FB) below is described.

(FA)

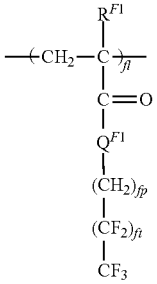

(FB)

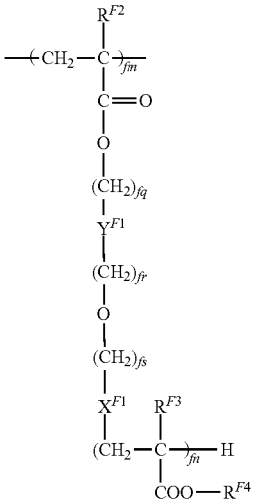

In general formulae (FA) and (FB), $R^{F1}$, $R^{F2}$, $R^{F3}$, and $R^{F4}$ each independently represent a hydrogen atom or an alkyl group.

$X^{F1}$ represents an alkylene chain, a halogen-substituted alkylene chain, —S—, —O—, —NH—, or a single bond.

$Y^{F1}$ represents an alkylene chain, a halogen-substituted alkylene chain, $—(C_{fx}H_{2fx-1}(OH))—$, or a single bond.

$Q^{F1}$ represents —O— or —NH—.

Furthermore, fl, fm, and fn each independently represent an integer of 1 or more; fp, fq, fr, and fs each independently represent 0 or an integer of 1 or more; ft represents an integer of 1 or more and 7 or less; and fx represents an integer of 1 or more.

In general formulae (FA) and (FB), a hydrogen atom, a methyl group, an ethyl group, a propyl group, etc., may be used as the groups represented by $R^{F1}$, $R^{F2}$, $R^{F3}$, and $R^{F4}$. A hydrogen atom and a methyl group are more preferable, and a methyl group is yet more preferable.

In general formulae (FA) and (FB), linear or branched alkylene groups having 1 to 10 carbon atoms may be used as the alkylene chains (unsubstituted alkylene chains and halogen-substituted alkylene chains) represented by $X^{F1}$ and $Y^{F1}$.

In $—(C_{fx}H_{2fx-1}(OH))—$ represented by $Y^{F1}$, fx may represent an integer of 1 or more and 10 or less.

Furthermore, fp, fq, fr, and fs may each independently represent 0 or an integer of 1 or more and 10 or less.

For example, fn may be 1 or more and 60 or less.

In the fluorine-containing dispersant, the ratio of the structural unit represented by general formula (FA) to the structural unit represented by structural unit (FB), in other words, fl:fm, may be in the range of 1:9 to 9:1 or may be in the range of 3:7 to 7:3.

The fluorine-containing dispersant may further contain a structural unit represented by general formula (FC) in addition to the structural unit represented by general formula (FA) and the structural unit represented by general formula (FB). The content ratio (fl+fm:fz) of the total (fl+fm) of the structural units represented by general formulae (FA) and (FB) to the structural unit represented by general formula (FC) may be in the range of 10:0 to 7:3 or may be in the range of 9:1 to 7:3.

(FC)

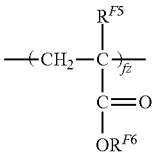

In general formula (FC), $R^{F5}$ and $R^{F6}$ each independently represent a hydrogen atom or an alkyl group. Furthermore, fz represents an integer of 1 or more.

In general formula (FC), a hydrogen atom, a methyl group, an ethyl group, a propyl group, etc., may be used as the groups represented by $R^{F5}$ and $R^{F6}$. A hydrogen atom and a methyl group are more preferable, and a methyl group is yet more preferable.

Examples of the commercially available products of the fluorine-containing dispersant include GF300 and GF400 (produced by Toagosei Co, Ltd.), Surflon (registered trademark) series (produced by AGC SEIMI CHEMICAL CO., LTD.), Ftergent series (produced by NEOS Company Limited), PF series (produced by Kitamura Chemicals Co., Ltd.), Megaface (registered trademark) series (produced by DIC Corporation), and FC series (produced by 3M).

The weight-average molecular weight of the fluorine-containing dispersant may be, for example, 2000 or more and 250000 or less, may be 3000 or more and 150000 or less, or may be 50000 or more and 100000 or less.

The weight-average molecular weight of the fluorine-containing dispersant is a value measured by gel permeation chromatography (GPC). The molecular weight measurement by GPC is conducted by, for example, using GPC·HLC-8120 produced by TOSOH CORPORATION as a measurement instrument with TSKgel GMHHR-M+TSKgel GMHHR-M columns (7.8 mm, I.D.: 30 cm) produced by TOSOH CORPORATION and a chloroform solvent, and calculating the molecular weight from the measurement results by using a molecular weight calibration curve prepared from a monodisperse polystyrene standard sample.

The amount of the fluorine-containing dispersant contained relative to, for example, the PTFE particle may be 0.5 mass % or more and 10 mass % or less, may be 1 mass % or more and 10 mass % or less, or may be 1 mass % or more and 7 mass % or less.

The fluorine-containing dispersants may be used alone or in combination.

Preparation of Dispersant-Attached PTFE Particles

Examples of the method for producing the dispersant-attached PTFE particles of the exemplary embodiment are as follows.

1) A method that involves adding PTFE particles and a fluorine-containing dispersant to a dispersion medium to prepare a dispersion of the PTFE particles and then removing the dispersion medium from the dispersion.

2) A method that involves mixing PTFE particles and a fluorine-containing dispersant in a dry-type powder mixer to attach the fluorine-containing dispersant to the PTFE particles.

3) A method that involves adding a fluorine-containing dispersant dissolved in a solvent to PTFE particles dropwise while stirring and then removing the solvent.

Composition

A composition according to an exemplary embodiment includes the dispersant-attached PTFE particles of the exemplary embodiment.

In other words, the composition of the exemplary embodiment contains dispersant-attached PTFE particles that contain PTFE particles and a fluorine-containing dispersant attached to surfaces of the PTFE particles, and the particle size distribution index [$D_{50}$-$D_{10}$] of the dispersant-attached PTFE particles is within the aforementioned range.

Thus, the composition of the exemplary embodiment has excellent PTFE particle dispersibility even when the state of the components mixed with the PTFE particles is changed.

The composition of the exemplary embodiment may be a composition prepared by mixing preliminarily prepared dispersant-attached PTFE particles and other components (for example, a dispersion medium and resin particles other than the PTFE particles) or may be a composition prepared by separately mixing PTFE particles, a fluorine-containing dispersant, and other components (for example, a dispersion medium and resin particles other than the PTFE particles).

The composition of the exemplary embodiment may be a liquid composition or a solid composition.

Examples of the liquid composition include a PTFE particle dispersion containing PTFE particles, a fluorine-containing dispersant, and a dispersion medium and a layer-shaped article-forming coating solution prepared by adding a resin to a PTFE particle dispersion.

An example of the solid composition is a composition that contains dispersant-attached PTFE particles and resin particles (for example, toner particles or powder coating material particles).

Layer-Shaped Article

A layer-shaped article according to an exemplary embodiment includes the dispersant-attached PTFE particles of the exemplary embodiment.

In other words, the layer-shaped article of the exemplary embodiment contains dispersant-attached PTFE particles that contain PTFE particles and a fluorine-containing dispersant attached to surfaces of the PTFE particles, and the particle size distribution index [$D_{50}$-$D_{10}$] of the dispersant-attached PTFE particles is within the aforementioned range. Specifically, the layer-shaped article of the exemplary embodiment is a layer formed from a composition of the exemplary embodiment.

Thus, the layer-shaped article of the exemplary embodiment has excellent PTFE particle dispersibility. In addition, the layer-shaped article of the exemplary embodiment has excellent surface properties, such as lubricity and hydrophobicity (water repellency) (in particular, surface properties with less non-uniformity).

Examples of the layer-shaped article of the exemplary embodiment include an outermost surface layer of an electrophotographic photoreceptor, a toner image, a powder coating layer, and a sliding layer.

In order for the layer-shaped article of the exemplary embodiment to exhibit the surface properties described above, the PTFE particle content relative to the layer-shaped article may be 0.1 mass % or more and 40 mass % or less or may be 1 mass % or more and 30 mass % or less.

Electrophotographic Photoreceptor

An electrophotographic photoreceptor (hereinafter may be referred to as a "photoreceptor") of an exemplary embodiment includes a conductive substrate and a photosensitive layer on the conductive substrate, in which the outermost surface layer is formed of the layer-shaped article of the exemplary embodiment.

Examples of the outermost surface layer formed of the layer-shaped article include a charge transporting layer of a multilayer photosensitive layer, a single-layer-type photosensitive layer, and a surface protection layer.

Since the photoreceptor of the exemplary embodiment has the layer-shaped article of the exemplary embodiment as the outermost surface layer, wear resistance is high. In particular, when the dispersibility of the PTFE particles contained in the outermost surface layer is low, the photoreceptor tends to exhibit image defects (specifically, streak-like image non-uniformity). However, the image defects are suppressed in the photoreceptor of the exemplary embodiment since the PTFE particles exhibiting excellent dispersibility are contained in the outermost surface layer.

The electrophotographic photoreceptor of the exemplary embodiment will now be described in detail by referring to the drawings.

An electrophotographic photoreceptor 7 illustrated in FIG. 1 includes, for example, a conductive support 4, and an undercoat layer 1, a charge generating layer 2, and a charge transporting layer 3 that are stacked in this order on the conductive support 4. The charge generating layer 2 and the charge transporting layer 3 constitute a photosensitive layer 5.

The electrophotographic photoreceptor 7 may have a layer structure that does not include the undercoat layer 1.

The electrophotographic photoreceptor 7 may include a single-layer-type photosensitive layer in which the functions of the charge generating layer 2 and the charge transporting layer 3 are integrated. In the case of a photosensitive layer having a single-layer-type photosensitive layer, the single-layer-type photosensitive layer constitutes the outermost surface layer.

Alternatively, the electrophotographic photoreceptor 7 may include a surface protection layer on the charge transporting layer 3 or the single-layer-type photosensitive layer. In the case of a photoreceptor having a surface protection layer, the surface protection layer constitutes the outermost surface layer.

In the description below, the respective layers of the electrophotographic photoreceptor of this exemplary embodiment are described in detail. In the description below, the reference signs are omitted.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steel etc.). Other examples of the conductive substrate include paper sheets, resin films, and belts coated, vapor-deposited, or laminated with conductive compounds (for example, conductive polymers and indium oxide), metals (for example, aluminum, palladium, and gold), or alloys. Here, "conductive" means having a volume resistivity of less than $10^{13}$ Ωcm.

The surface of the conductive substrate may be roughened to a center-line average roughness Ra of 0.04 μm or more and 0.5 μm or less in order to suppress interference fringes that occur when the electrophotographic photoreceptor used in a laser printer is irradiated with a laser beam. When incoherent light is used as a light source, there is no need to roughen the surface to prevent interference fringes, but roughening the surface suppresses generation of defects due to irregularities on the surface of the conductive substrate and thus is desirable for extending the lifetime.

Examples of the surface roughening method include a wet honing method with which an abrasive suspended in water is sprayed onto a conductive support, a centerless grinding with which a conductive substrate is pressed against a rotating grinding stone to perform continuous grinding, and an anodization treatment.

Another example of the surface roughening method does not involve roughening the surface of a conductive substrate but involves dispersing a conductive or semi-conductive powder in a resin and forming a layer of the resin on a surface of a conductive substrate so as to create a rough surface by the particles dispersed in the layer.

The surface roughening treatment by anodization involves forming an oxide film on the surface of a conductive substrate by anodization by using a metal (for example, aluminum) conductive substrate as the anode in an electrolyte solution. Examples of the electrolyte solution include a sulfuric acid solution and an oxalic acid solution. However, a porous anodization film formed by anodization is chemically active as is, is prone to contamination, and has resistivity that significantly varies depending on the environment. Thus, a pore-sealing treatment may be performed on the porous anodization film so as to seal fine pores in the oxide film by volume expansion caused by hydrating reaction in pressurized steam or boiling water (a metal salt such as a nickel salt may be added) so that the oxide is converted into a more stable hydrous oxide.

The thickness of the anodization film may be, for example, 0.3 μm or more and 15 μm or less. When the thickness is within this range, a barrier property against injection tends to be exhibited, and the increase in residual potential caused by repeated use tends to be suppressed.

The conductive substrate may be subjected to a treatment with an acidic treatment solution or a Boehmite treatment.

The treatment with an acidic treatment solution is, for example, conducted as follows. First, an acidic treatment solution containing phosphoric acid, chromic acid, and hydrofluoric acid is prepared. The blend ratios of phosphoric acid, chromic acid, and hydrofluoric acid in the acidic treatment solution may be, for example, in the range of 10 mass % or more and 11 mass % or less for phosphoric acid, in the range of 3 mass % or more and 5 mass % or less for chromic acid, and in the range of 0.5 mass % or more and 2 mass % or less for hydrofluoric acid; and the total concentration of these acids may be in the range of 13.5 mass % or more and 18 mass % or less. The treatment temperature may be, for example, 42° C. or higher and 48° C. or lower. The thickness of the film may be 0.3 μm or more and 15 μm or less.

The Boehmite treatment is conducted by immersing a conductive substrate in pure water at 90° C. or higher and 100° C. or lower for 5 to 60 minutes or by bringing a conductive substrate into contact with pressurized steam at 90° C. or higher and 120° C. or lower for 5 to 60 minutes. The thickness of the film may be 0.1 μm or more and 5 μm or less. The Boehmite-treated body may be further anodized by using an electrolyte solution, such as adipic acid, boric acid, a borate salt, a phosphate salt, a phthalate salt, a maleate salt, a benzoate salt, a tartrate salt, or a citrate salt, that has low film-dissolving power.

Undercoat Layer

The undercoat layer is, for example, a layer that contains inorganic particles and a binder resin.

Examples of the inorganic particles include inorganic particles having a powder resistivity (volume resistivity) of $10^2$ Ωcm or more and $10^{11}$ Ωcm or less.

As the inorganic particles having this resistance value, for example, metal oxide particles such as tin oxide particles, titanium oxide particles, zinc oxide particles, or zirconium oxide particles may be used, and, in particular, zinc oxide particles may be used.

The specific surface area of the inorganic particles measured by the BET method may be, for example, 10 $m^2/g$ or more.

The volume-average particle diameter of the inorganic particles may be, for example, 50 nm or more and 2000 nm or less (or may be 60 nm or more and 1000 nm or less).

The amount of the inorganic particles contained relative to the binder resin is, for example, 10 mass % or more and 80 mass % or less, or may be 40 mass % or more and 80 mass % or less.

The inorganic particles may be surface-treated. A mixture of two or more inorganic particles subjected to different surface treatments or having different particle diameters may be used.

Examples of the surface treatment agent include a silane coupling agent, a titanate-based coupling agent, an aluminum-based coupling agent, and a surfactant. In particular, a silane coupling agent may be used, and an amino-group-containing silane coupling agent may be used.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be mixed and used. For example, an amino-group-containing silane coupling agent may be used in combination with an additional silane coupling agent. Examples of this additional silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxy silane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method that uses a surface treatment agent may be any known method, for example, may be a dry method or a wet method.

The treatment amount of the surface treatment agent may be, for example, 0.5 mass % or more and 10 mass % or less relative to the inorganic particles.

Here, the undercoat layer may contain inorganic particles and an electron-accepting compound (acceptor compound) from the viewpoints of long-term stability of electrical properties and carrier blocking properties.

Examples of the electron-accepting compound include electron transporting substances, such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, a compound having an anthraquinone structure may be used as the electron-accepting compound. Examples of the compound having an anthraquinone structure include hydroxyanthraquinone compounds, aminoanthraquinone compounds, and aminohydroxyanthraquinone compounds, and more specific examples thereof include anthraquinone, alizarin, quinizarin, anthrarufin, and purpurin.

The electron-accepting compound may be dispersed in the undercoat layer along with the inorganic particles, or may be attached to the surfaces of the inorganic particles.

Examples of the method for attaching the electron-accepting compound onto the surfaces of the inorganic particles include a dry method and a wet method.

The dry method is, for example, a method with which, while inorganic particles are stirred with a mixer or the like having a large shear force, an electron-accepting compound as is or dissolved in an organic solvent is added dropwise or sprayed along with dry air or nitrogen gas so as to cause the electron-accepting compound to attach to the surfaces of the inorganic particles. When the electron-accepting compound is added dropwise or sprayed, the temperature may be equal to or lower than the boiling point of the solvent. After the electron-accepting compound is added dropwise or sprayed, baking may be further conducted at 100° C. or higher. The temperature and time for baking are not particularly limited as long as the electrophotographic properties are obtained.

The wet method is, for example, a method with which, while inorganic particles are dispersed in a solvent by stirring, ultrasonically, or by using a sand mill, an attritor, or a ball mill, the electron-accepting compound is added, followed by stirring or dispersing, and then the solvent is removed to cause the electron-accepting compound to attach to the surfaces of the inorganic particles. The solvent is removed by, for example, filtration or distillation. After removing the solvent, baking may be further conducted at 100° C. or higher. The temperature and time for baking are not particularly limited as long as the electrophotographic properties are obtained. In the wet method, the moisture contained in the inorganic particles may be removed before adding the electron-accepting compound. For example, the moisture may be removed by stirring and heating the inorganic particles in a solvent or by boiling together with the solvent.

Attaching the electron-accepting compound may be conducted before, after, or simultaneously with the surface treatment of the inorganic particles by a surface treatment agent.

The amount of the electron-accepting compound contained relative to the inorganic particles may be, for example, 0.01 mass % or more and 20 mass % or less, or may be 0.01 mass % or more and 10 mass % or less.

Examples of the binder resin used in the undercoat layer include known materials such as known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and silane coupling agents.

Other examples of the binder resin used in the undercoat layer include charge transporting resins that have charge transporting groups, and conductive resins (for example, polyaniline).

Among these, a resin that is insoluble in the coating solvent in the overlying layer is suitable as the binder resin used in the undercoat layer. Examples of the particularly suitable resin include thermosetting resins such as a urea resin, a phenolic resin, a phenol-formaldehyde resin, a melamine resin, a urethane resin, an unsaturated polyester resin, an alkyd resin, and an epoxy resin; and a resin obtained by a reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin.

When two or more of these binder resins are used in combination, the mixing ratios are set as necessary.

The undercoat layer may contain various additives to improve electrical properties, environmental stability, and image quality.

Examples of the additives include known materials such as electron transporting pigments based on polycyclic condensed materials and azo materials, zirconium chelate compounds, titanium chelate compounds, aluminum chelate compounds, titanium alkoxide compounds, organic titanium compounds, and silane coupling agents. The silane coupling agent is used to surface-treat the inorganic particles as mentioned above, but may be further added as an additive to the undercoat layer.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxyaluminum diisopropylate, aluminum butylate, diethylacetoacetate aluminum diisopropylate, and aluminum tris(ethylacetoacetate).

These additives may be used alone, or two or more compounds may be used as a mixture or a polycondensation product.

The undercoat layer may have a Vickers hardness of 35 or more.

In order to suppress moire images, the surface roughness (ten-point average roughness) of the undercoat layer may be adjusted to be in the range of 1/(4n) (n represents the refractive index of the overlying layer) to ½ of λ representing the laser wavelength used for exposure.

In order to adjust the surface roughness, resin particles and the like may be added to the undercoat layer. Examples of the resin particles include silicone resin particles and crosslinking polymethyl methacrylate resin particles. In order to adjust the surface roughness, the surface of the undercoat layer may be polished. Examples of the polishing method included buff polishing, sand blasting, wet honing, and grinding.

The undercoat layer may be formed by any known method. For example, a coating film is formed by using an undercoat-layer-forming solution prepared by adding the above-mentioned components to a solvent, dried, and, if needed, heated.

Examples of the solvent used for preparing the undercoat-layer-forming solution include known organic solvents, such as alcohol solvents, aromatic hydrocarbon solvents, halogenated hydrocarbon solvents, ketone solvents, ketone alcohol solvents, ether solvents, and ester solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing inorganic particles in preparing the undercoat-layer-forming solution include known methods that use a roll mill, a ball mill, a vibrating ball mill, an attritor, a sand mill, a colloid mill, and a paint shaker.

Examples of the method for applying the undercoat-layer-forming solution to the conductive substrate include common methods such as a blade coating method, a wire bar coating method, a spray coating method, a dip coating method, a bead coating method, an air knife coating method, and a curtain coating method.

The thickness of the undercoat layer is set within the range of, for example, 15 μm or more, and may be set within the range of 20 μm or more and 50 μm or less.

Intermediate Layer

Although not illustrated in the drawings, an intermediate layer may be further provided between the undercoat layer and the photosensitive layer.

The intermediate layer is, for example, a layer that contains a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may contain an organic metal compound. Examples of the organic metal compound used in the intermediate layer include organic metal compounds containing metal atoms such as zirconium, titanium, aluminum, manganese, and silicon.

These compounds used in the intermediate layer may be used alone, or two or more compounds may be used as a mixture or a polycondensation product.

In particular, the intermediate layer may be a layer that contains an organic metal compound that contains zirconium atoms or silicon atoms.

The intermediate layer may be formed by any known method. For example, a coating film is formed by using an intermediate-layer-forming solution prepared by adding the above-mentioned components to a solvent, dried, and, if needed, heated.

Examples of the application method for forming the intermediate layer include common methods such as a dip coating method, a lift coating method, a wire bar coating method, a spray coating method, a blade coating method, a knife coating method, and a curtain coating method.

The thickness of the intermediate layer may be set within the range of, for example, 0.1 μm or more and 3 μm or less. The intermediate layer may be used as the undercoat layer.

Charge Generating Layer

The charge generating layer is, for example, a layer that contains a charge generating material and a binder resin. The charge generating layer may be a vapor deposited layer of a charge generating material. The vapor deposited layer of the charge generating material may be used when an incoherent light such as a light emitting diode (LED) or an organic electro-luminescence (EL) image array is used.

Examples of the charge generating material include azo pigments such as bisazo and trisazo pigments; fused-ring aromatic pigments such as dibromoanthanthrone; perylene pigments; pyrrolopyrrole pigments; phthalocyanine pigments; zinc oxide; and trigonal selenium.

Among these, in order to be compatible to the near-infrared laser exposure, a metal phthalocyanine pigment or a metal-free phthalocyanine pigment may be used as the charge generating material. Specific examples thereof include hydroxygallium phthalocyanine, chlorogallium phthalocyanine, dichlorotin phthalocyanine, and titanyl phthalocyanine.

In order to be compatible to the near ultraviolet laser exposure, the charge generating material may be a fused-ring aromatic pigment such as dibromoanthanthrone, a thioindigo pigment, a porphyrazine compound, zinc oxide, trigonal selenium, a bisazo pigment.

When an incoherent light source, such as an LED or an organic EL image array having an emission center wavelength in the range of 450 nm or more and 780 nm or less, is used, the charge generating material described above may be used; however, from the viewpoint of the resolution, when the photosensitive layer is as thin as 20 μm or less, the electric field intensity in the photosensitive layer is increased, charges injected from the substrate are decreased, and image defects known as black spots tend to occur. This is particularly noticeable when a charge generating material, such as trigonal selenium or a phthalocyanine pigment, that is of a p-conductivity type and easily generates dark current is used.

In contrast, when an n-type semiconductor, such as a fused-ring aromatic pigment, a perylene pigment, or an azo pigment, is used as the charge generating material, dark current rarely occurs and, even when the thickness is small, image defects known as black spots can be suppressed.

Whether n-type or not is determined by a time-of-flight method commonly employed, on the basis of the polarity of the photocurrent flowing therein. A material in which electrons flow more smoothly as carriers than holes is determined to be of an n-type.

The binder resin used in the charge generating layer is selected from a wide range of insulating resins. Alternatively, the binder resin may be selected from organic photoconductive polymers, such as poly-N-vinylcarbazole, polyvinyl anthracene, polyvinyl pyrene, and polysilane.

Examples of the binder resin include, polyvinyl butyral resins, polyarylate resins (polycondensates of bisphenols and aromatic dicarboxylic acids etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, "insulating" means having a volume resistivity of $10^{13}$ Ωcm or more.

These binder resins are used alone or in combination as a mixture.

The blend ratio of the charge generating material to the binder resin may be in the range of 10:1 to 1:10 on a mass ratio basis.

The charge generating layer may contain other known additives.

The charge generating layer may be formed by any known method. For example, a coating film is formed by using an charge-generating-layer-forming solution prepared by adding the above-mentioned components to a solvent, dried, and, if needed, heated. The charge generating layer may be formed by vapor-depositing a charge generating material. The charge generating layer may be formed by vapor deposition particularly when a fused-ring aromatic pigment or a perylene pigment is used as the charge generating material.

Specific examples of the solvent for preparing the charge-generating-layer-forming solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination as a mixture.

The method for dispersing particles (for example, the charge generating material) in the charge-generating-layer-forming solution can use a media disperser such as a ball mill, a vibrating ball mill, an attritor, a sand mill, or a horizontal sand mill, or a media-less disperser such as stirrer, an ultrasonic disperser, a roll mill, or a high-pressure homogenizer. Examples of the high-pressure homogenizer include a collision-type homogenizer in which the dispersion in a high-pressure state is dispersed through liquid-liquid collision or liquid-wall collision, and a penetration-type homogenizer in which the fluid in a high-pressure state is caused to penetrate through fine channels.

In dispersing, it is effective to set the average particle diameter of the charge generating material in the charge-generating-layer-forming solution to 0.5 μm or less, 0.3 μm or less, or 0.15 μm or less.

Examples of the method for applying the charge-generating-layer-forming solution to the undercoat layer (or the intermediate layer) include common methods such as a blade coating method, a wire bar coating method, a spray coating method, a dip coating method, a bead coating method, an air knife coating method, and a curtain coating method.

The thickness of the charge generating layer may be set within the range of, for example, 0.1 μm or more and 5.0 μm or less, or with in the range of 0.2 μm or more and 2.0 μm or less.

Charge Transporting Layer

The charge transporting layer is, for example, a layer that contains a charge transporting material and a binder resin.

The charge transporting layer may be a layer that contains a polymer charge transporting material.

Examples of the charge transporting material include electron transporting compounds such as quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge transporting material include hole transporting compounds such as triarylamine compounds, benzidine compounds, aryl alkane compounds, aryl-substituted ethylene compounds, stilbene compounds, anthracene compounds, and hydrazone compounds. These charge transporting materials may be used alone or in combination, but are not limiting.

From the viewpoint of charge mobility, the charge transporting material may be a triaryl amine derivative represented by structural formula (a-1) below or a benzidine derivative represented by structural formula (a-2) below.

(a-1)

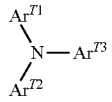

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

(a-2)

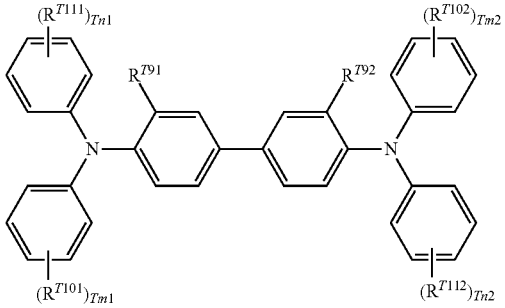

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 or more and 2 or less.

Examples of the substituent for each of the groups described above include a halogen atom, an alkyl group having 1 to 5 carbon atoms, and an alkoxy group having 1 to 5 carbon atoms. Examples of the substituent for each of the groups described above include a substituted amino group substituted with an alkyl group having 1 to 3 carbon atoms.

Here, among the triarylamine derivatives represented by structural formula (a-1) and the benzidine derivatives represented by structural formula (a-2) above, a triarylamine derivative having $—C_6H_4—CH=CH—CH=C(R^{T7})(R^{T8})$ or a benzidine derivative having $—CH=CH—CH=C(R^{T15})(R^{T16})$ may be used from the viewpoint of the charge mobility.

Examples of the polymer charge transporting material that can be used include known charge transporting materials such as poly-N-vinylcarbazole and polysilane. In particular, polyester polymer charge transporting materials may be used. The polymer charge transporting material may be used alone or in combination with a binder resin.

Examples of the binder resin used in the charge transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, a polycarbonate resin or a polyarylate resin may be used as the binder resin. These binder resins are used alone or in combination.

The blend ratio of the charge transporting material to the binder resin may be in the range of 10:1 to 1:5 on a mass ratio basis.

The charge transporting layer may contain other known additives.

The charge transporting layer may be formed by any known method. For example, a coating film is formed by using an charge-transporting-layer-forming solution prepared by adding the above-mentioned components to a solvent, dried, and, if needed, heated.

Examples of the solvent used to prepare the charge-transporting-layer-forming solution include common organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents are used alone or in combination as a mixture.

Examples of the method for applying the charge-transporting-layer-forming solution to the charge generating layer include common methods such as a blade coating method, a wire bar coating method, a spray coating method, a dip coating method, a bead coating method, an air knife coating method, and a curtain coating method.

The thickness of the charge transporting layer may be set within the range of, for example, 5 μm or more and 50 μm or less, or within the range of 10 μm or more and 30 μm or less.

Protection Layer

A protection layer is disposed on a photosensitive layer if necessary. The protection layer is, for example, formed to avoid chemical changes in the photosensitive layer in a charged state and further improve the mechanical strength of the photosensitive layer.

Thus, the protection layer may be a layer formed of a cured film (crosslinked film). Examples of such a layer include layers indicated in 1) and 2) below.

1) A layer formed of a cured film of a composition that contains a reactive-group-containing charge transporting material having a reactive group and a charge transporting skeleton in the same molecule (in other words, a layer that contains a polymer or crosslinked body of the reactive-group-containing charge transporting material).

2) A layer formed of a cured film of a composition that contains a non-reactive charge transporting material, and a reactive-group-containing non-charge transporting material that does not have a charge transporting skeleton but has a reactive group (in other words, a layer that contains a polymer or crosslinked body of the non-reactive charge transporting material and the reactive-group-containing non-charge transporting material).

Examples of the reactive group contained in the reactive-group-containing charge transporting material include chain-polymerizable groups, an epoxy group, —OH, —OR (where R represents an alkyl group), —$NH_2$, —SH, —COOH, and —$SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain-polymerizable group may be any radical-polymerizable functional group, and an example thereof is a functional group having a group that contains at least a carbon-carbon double bond. A specific example thereof is a group that contains at least one selected from a vinyl group, a vinyl ether group, a vinyl thioether group, a styryl group (vinylphenyl group), an acryloyl group, a methacryloyl group, and derivatives of the foregoing. Among these, the chain-polymerizable group may be a group that contains at least one selected from a vinyl group, a vinylphenyl group, an acryloyl group, a methacryloyl group, and derivatives thereof due to their excellent reactivity.

The charge transporting skeleton of the reactive-group-containing charge transporting material may be any known structure used in the electrophotographic photoreceptor, and examples thereof include skeletons that are derived from nitrogen-containing hole transporting compounds, such as triarylamine compounds, benzidine compounds, and hydrazone compounds, and that are conjugated with nitrogen atoms. Among these, a triarylamine skeleton may be used.

The reactive-group-containing charge transporting material that has such a reactive group and a charge transporting skeleton, the non-reactive charge transporting material, and the reactive-group-containing non-charge transporting material may be selected from among known materials.

The protection layer may contain other known additives.

The protection layer may be formed by any known method. For example, a coating film is formed by using a protective-layer-forming solution prepared by adding the above-mentioned components to a solvent, dried, and, if needed, cured such as by heating.

Examples of the solvent used to prepare the protective-layer-forming solution include aromatic solvents such as toluene and xylene, ketone solvents such as methyl ethyl ketone, methyl isobutyl ketone, and cyclohexanone, ester solvents such as ethyl acetate and butyl acetate, ether solvents such as tetrahydrofuran and dioxane, cellosolve solvents such as ethylene glycol monomethyl ether, and alcohol solvents such as isopropyl alcohol and butanol. These solvents are used alone or in combination as a mixture.

The protective-layer-forming solution may be a solvent-free solution.

Examples of the application method used to apply the protective-layer-forming solution onto the photosensitive layer (for example, the charge transporting layer) include common methods such as a dip coating method, a lift coating method, a wire bar coating method, a spray coating method, a blade coating method, a knife coating method, and a curtain coating method.

The thickness of the protection layer may be set within the range of, for example, 1 μm or more and 20 μm or less, or within the range of 2 μm or more and 10 μm or less.

Single-Layer-Type Photosensitive Layer

The single-layer-type photosensitive layer (charge generating/charge transporting layer) is, for example, a layer that contains a charge generating material, a charge transporting material, and, if needed, a binder resin and other known additives. These materials are the same as those described for the charge generating layer and the charge transporting layer.

The amount of the charge generating material contained in the single-layer-type photosensitive layer relative to the total solid content may be 0.1 mass % or more and 10 mass % or less, or may be 0.8 mass % or more and 5 mass % or less. The amount of the charge transporting material contained in the single-layer-type photosensitive layer relative to the total solid content may be 5 mass % or more and 50 mass % or less.

The method for forming the single-layer-type photosensitive layer is the same as the method for forming the charge generating layer and the charge transporting layer.

The thickness of the single-layer-type photosensitive layer may be, for example, 5 μm or more and 50 μm or less, or 10 μm or more and 40 μm or less.

Image Forming Apparatus and Process Cartridge

An image forming apparatus of an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor by using a developer that contains a toner so as to form a toner image, and a transfer unit that transfers the toner image onto a surface of a recording medium. The electrophotographic photoreceptor of the exemplary embodiment described above is used as the electrophotographic photoreceptor.

The image forming apparatus of the exemplary embodiment is applied to a known image forming apparatus, examples of which include an apparatus equipped with a fixing unit that fixes the toner image transferred onto the surface of the recording medium; a direct transfer type apparatus with which the toner image formed on the surface of the electrophotographic photoreceptor is directly transferred to the recording medium; an intermediate transfer type apparatus with which the toner image formed on the surface of the electrophotographic photoreceptor is first transferred to a surface of an intermediate transfer body and then the toner image on the surface of the intermediate transfer body is transferred to the surface of the recording medium; an apparatus equipped with a cleaning unit that cleans the surface of the electrophotographic photoreceptor after the toner image transfer and before charging; an apparatus equipped with a charge erasing unit that erases the charges on the surface of the electrophotographic photoreceptor by applying the charge erasing light after the toner image transfer and before charging; and an apparatus equipped with an electrophotographic photoreceptor heating member that elevates the temperature of the electrophotographic photoreceptor to reduce the relative temperature.

In the intermediate transfer type apparatus, the transfer unit includes, for example, an intermediate transfer body having a surface onto which a toner image is to be transferred, a first transfer unit that conducts first transfer of the toner image on the surface of the electrophotographic photoreceptor onto the surface of the intermediate transfer body, and a second transfer unit that conducts second transfer of the toner image on the surface of the intermediate transfer body onto a surface of a recording medium.

The image forming apparatus of this exemplary embodiment may be of a dry development type or a wet development type (development type that uses a liquid developer).

In the image forming apparatus of the exemplary embodiment, for example, a section that includes the electrophotographic photoreceptor may be configured as a cartridge structure (process cartridge) detachably attachable to the image forming apparatus. A process cartridge equipped with the electrophotographic photoreceptor of the exemplary embodiment may be used as this process cartridge. The process cartridge may include, in addition to the electrophotographic photoreceptor, at least one selected from the group consisting of a charging unit, an electrostatic latent image forming unit, a developing unit, and a transfer unit.

Although some examples of the image forming apparatus of an exemplary embodiment are described below, these examples are not limiting. Only relevant sections illustrated in the drawings are described, and descriptions of other sections are omitted.

Figure 2:
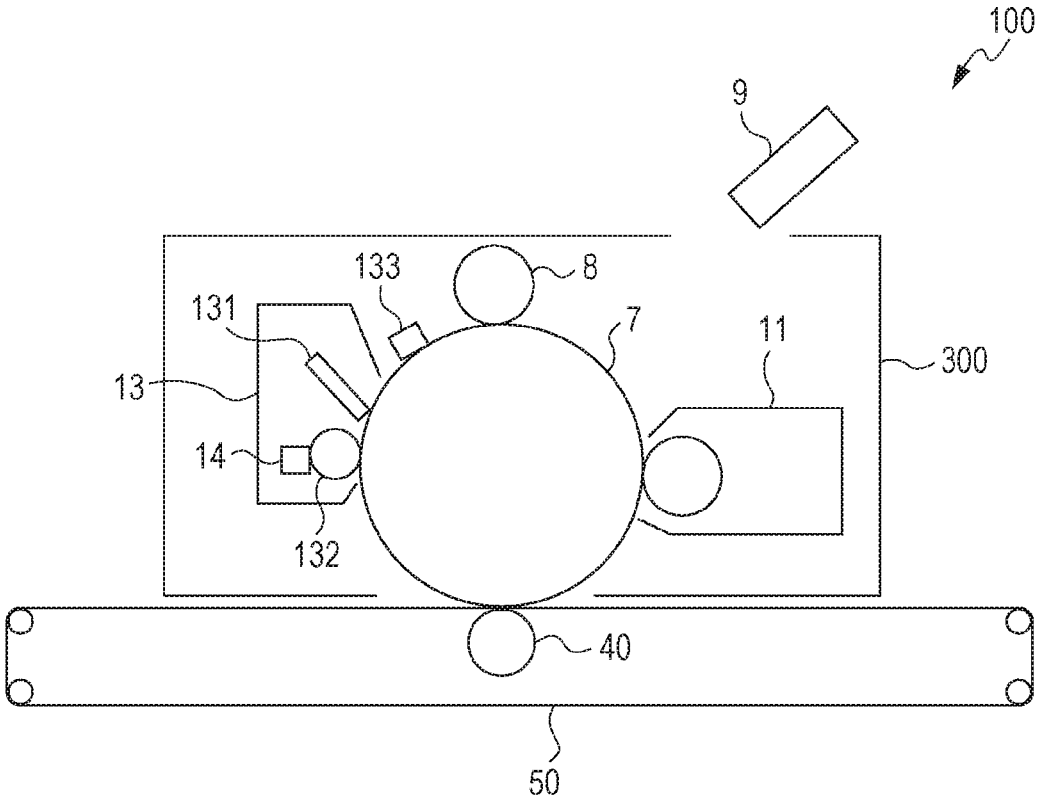
FIG. 2 is a schematic diagram illustrating one example of an image forming apparatus according to an exemplary embodiment.

FIG. 2 is a schematic diagram illustrating one example of an image forming apparatus according to an exemplary embodiment;

As illustrated in FIG. 2, an image forming apparatus 100 of this exemplary embodiment includes a process cartridge 300 equipped with an electrophotographic photoreceptor 7, an exposing device 9 (one example of the electrostatic latent image forming unit), a transfer device 40 (first transfer device), and an intermediate transfer body 50. In this image forming apparatus 100, an exposing device 9 is positioned so that light can be applied to the electrophotographic photoreceptor 7 from the opening of the process cartridge 300, the transfer device 40 is positioned to oppose the electrophotographic photoreceptor 7 with the intermediate transfer body 50 therebetween, and the intermediate transfer body 50 has a portion in contact with the electrophotographic photoreceptor 7. Although not illustrated in the drawings, a second transfer device that transfers the toner image on the intermediate transfer body 50 onto a recording medium (for example, a paper sheet) is also provided. The intermediate transfer body 50, the transfer device 40 (first transfer device), and the second transfer device (not illustrated) correspond to examples of the transfer unit.

The process cartridge 300 illustrated in FIG. 2 integrates and supports the electrophotographic photoreceptor 7, a charging device 8 (one example of the charging unit), a developing device 11 (one example of the developing unit), and a cleaning device 13 (one example of the cleaning unit) in the housing. The cleaning device 13 has a cleaning blade (one example of the cleaning member) 131, and the cleaning blade 131 is in contact with the surface of the electrophotographic photoreceptor 7. The cleaning member may take a form other than the cleaning blade 131, and may be a conductive or insulating fibrous member that can be used alone or in combination with the cleaning blade 131.

Although an example of the image forming apparatus equipped with a fibrous member 132 (roll) that supplies a lubricant 14 to the surface of the electrophotographic photoreceptor 7 and a fibrous member 133 (flat brush) that assists cleaning is illustrated in FIG. 2, these members are optional.

The features of the image forming apparatus of this exemplary embodiment will now be described.

Charging Device

Examples of the charging device 8 include contact-type chargers that use conductive or semi-conducting charging rollers, charging brushes, charging films, charging rubber blades, and charging tubes. Known chargers such as non-contact-type roller chargers, and scorotron chargers and corotron chargers that utilize corona discharge are also be used.

Exposing Device

Examples of the exposing device 9 include optical devices that can apply light, such as semiconductor laser light, LED light, or liquid crystal shutter light, into a particular image shape onto the surface of the electrophotographic photoreceptor 7. The wavelength of the light source is to be within the spectral sensitivity range of the electrophotographic photoreceptor. The mainstream wavelength of the semiconductor lasers is near infrared having an oscillation wavelength at about 780 nm. However, the wavelength is not limited to this, and a laser having an oscillation wavelength on the order of 600 nm or a blue laser having an oscillation wavelength of 400 nm or more and 450 nm or less may be used. In order to form a color image, a surface-emitting laser light source that can output multi beams is also effective.

Developing Device

Examples of the developing device 11 include common developing devices that perform development by using a developer in contact or non-contact manner. The developing device 11 is not particularly limited as long as the aforementioned functions are exhibited, and is selected according to the purpose. An example thereof is a known developer that has a function of attaching a one-component developer or a two-component developer to the electrophotographic photoreceptor 7 by using a brush, a roller, or the like. In particular, a development roller that retains the developer on its surface may be used.

The developer used in the developing device 11 may be a one-component developer that contains only a toner or a two-component developer that contains a toner and a carrier. The developer may be magnetic or non-magnetic. Any known developers may be used as these developers.

Cleaning Device

A cleaning blade type device equipped with a cleaning blade 131 is used as the cleaning device 13.

Instead of the cleaning blade type, a fur brush cleaning type device or a development-cleaning simultaneous type device may be employed.

Transfer Device

Examples of the transfer device 40 include contact-type transfer chargers that use belts, rollers, films, rubber blades, etc., and known transfer chargers such as scorotron transfer chargers and corotron transfer chargers that utilize corona discharge.

Intermediate Transfer Body

A belt-shaped member (intermediate transfer belt) that contains semi-conducting polyimide, polyamide imide, polycarbonate, polyarylate, a polyester, a rubber or the like is used as the intermediate transfer body 50. The form of the intermediate transfer body other than the belt may be a drum.

Figure 3:
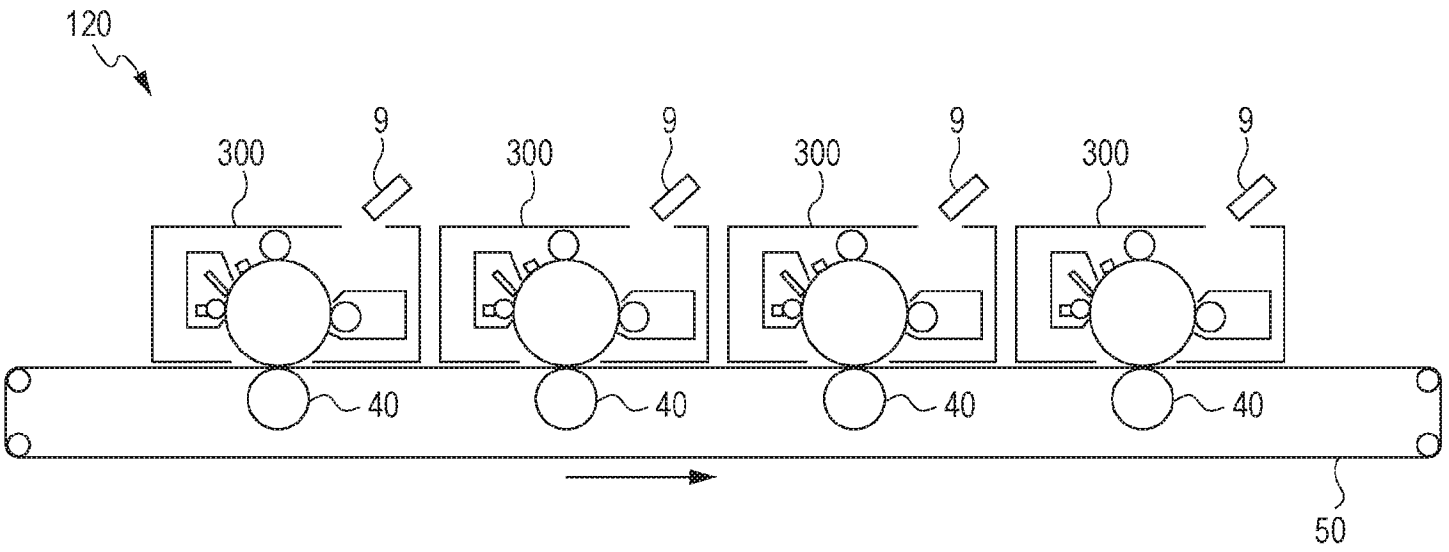
FIG. 3 is a schematic diagram illustrating another example of the image forming apparatus according to the exemplary embodiment.

FIG. 3 is a schematic diagram illustrating another example of the image forming apparatus according to the exemplary embodiment.

An image forming apparatus 120 illustrated in FIG. 3 is a tandem-system multicolor image forming apparatus equipped with four process cartridges 300. In the image forming apparatus 120, four process cartridges 300 are arranged in parallel on the intermediate transfer body 50, and one electrophotographic photoreceptor is used for one color. The image forming apparatus 120 is identical to the image forming apparatus 100 except for the tandem system.

Other Usages of Dispersant-Attached PTFE Particles

The dispersant-attached PTFE particles of the exemplary embodiment are suitable for use as an external additive for a toner, and an external additive for a powder coating material.

For example, when the dispersant-attached PTFE particles are used as an external additive for a toner, examples of the toner include a toner for developing an electrostatic charge image, the toner containing toner particles and, as an external additive, the dispersant-attached PTFE particles of this exemplary embodiment. The toner particles contain a resin (binder resin). The toner particles further contain a coloring agent, a releasing agent, and other additives if needed.

When the dispersant-attached PTFE particles are used as an external additive for a powder coating material, an example of the powder coating material is a powder coating material that contains powder particles and, as an external additive, the dispersant-attached PTFE particles of this exemplary embodiment. The powder particles contain a thermosetting resin and a thermal curing agent. The powder particles contain other additives such as a coloring agent if needed.

EXAMPLES

Examples of the present disclosure will now be described in further detail, but the present disclosure is not limited by the examples. Unless otherwise noted, "parts" and "%" are on a mass basis.

Example 1

Preparation of Dispersant-Attached PTFE Particles A

As the PTFE particles, Lubron L-2 (produced by Daikin Industries, Ltd., specific surface area: 8 $m^2/g$, apparent density: 0.35 g/ml (JIS K 6891 (1995)), melting temperature: 328° C. (JIS K 6891 (1995))) is used. As described below, the PTFE particles are washed and then treated with a fluorine-containing dispersant to form dispersant-attached PTFE particles A.

Four hundred parts by mass of tetrahydrofuran and 15 parts by mass of the PTFE particles are taken to prepare a mixture, the pressure of a high-pressure homogenizer (trade name: LA-33S produced by NANOMIZER Inc.) is set at 500 $kg/cm^2$, and the mixture is passed through the high-pressure homogenizer four times to wash the mixture. After the resulting dispersion is treated in a centrifugal separator, the liquid in the transparent upper layer portion is removed. Next, tetrahydrofuran is added so that the amount of the liquid is 415 parts by mass, and after the resulting mixture is again dispersed in a high-pressure homogenizer, the resulting dispersion is treated in a centrifugal separator, and the liquid in the transparent upper layer portion is removed. This operation is further repeated three times. Subsequently, as the fluorine-containing dispersant, 1.5 parts of GF400 (produced by Toagosei Co, Ltd., a surfactant in which at least a methacrylate having a fluorinated alkyl group is used as the polymerization component) is added to the resulting mixture, tetrahydrofuran is added so that the amount of the liquid is 415 parts by mass, and after the resulting mixture is again dispersed in a high-pressure homogenizer, the solvent is distilled away at a reduced pressure. Then, the dried particles are pulverized in a mortar. The resulting particles are assumed to be the dispersant-attached PTFE particles A.

Preparation of PTFE Composition L-A

In 350 parts of toluene and 150 parts of tetrahydrofuran, 45 parts of a benzidine compound represented by formula (CT-1) below and 55 parts of a polymer compound (viscosity-average molecular weight: 40,000) having a repeating unit represented by formula (B-1) below are dissolved, 10 parts of the dispersant-attached PTFE particles A are added to the resulting solution, and the resulting mixture is treated five times with a high-pressure homogenizer to prepare a PTFE composition L-A.

(CT-1)

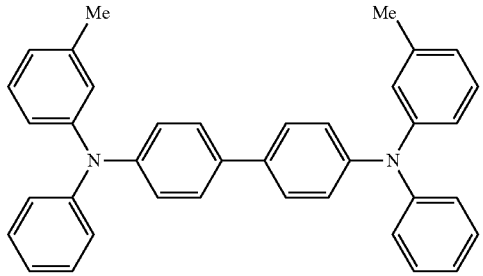

(B-1)

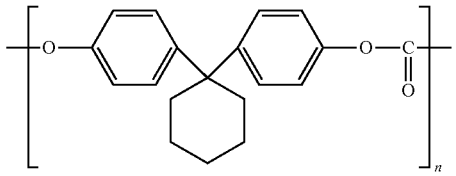

Evaluation of PTFE Composition L-A

The dispersed state of the PTFE particles in the obtained PTFE composition L-A is evaluated by using a laser diffraction particle size analyzer (MASTERSIZER 3000: Malvern), and the average particle diameter is found to be 0.22 μm.

Evaluation and Preparation of PTFE Layer-Shaped Article F-A

The PTFE composition L-A is applied to a glass substrate by using a gap coater, and heated at 130° C. for 45 minutes to prepare a PTFE layer-shaped article F-A having a thickness of 5 μm. The average particle diameter of the PTFE particles in the obtained layer-shaped article is 0.23 μm.

Measurement of Particle Diameter

The obtained layer-shaped article is observed with a scanning electron microscope (SEM) through the aforementioned method so as to measure the maximum diameters of the dispersant-attached PTFE particles A, and measure or calculate the particle size distribution index [$D_{50}$-$D_{10}$], the super-small-diameter-side particle size distribution index [$D_5$], and the average primary particle diameter. The results are indicated in Table 1.

Preparation of Electrophotographic Photoreceptor A

A photoreceptor A is prepared as follows.

Formation of Undercoat Layer

One hundred parts of zinc oxide (average particle diameter: 70 nm, produced by Tayca Corporation, specific surface area: 15 $m^2/g$) is mixed with 500 parts of tetrahydrofuran, and 1.3 parts of a silane coupling agent (KBM503 produced by Shin-Etsu Chemical Co., Ltd.) is added thereto, followed by stirring for 2 hours. Then, tetrahydrofuran is distilled away by vacuum distillation, baking is performed at 120° C. for 3 hours, and, as a result, zinc oxide surface-treated with the silane coupling agent is obtained.

One hundred and ten parts of the surface-treated zinc oxide and 500 parts of tetrahydrofuran are mixed and stirred, a solution prepared by dissolving 0.6 parts of alizarin in 50 parts of tetrahydrofuran is added to the resulting mixture, and the resulting mixture is stirred at 50° C. for 5 hours. Subsequently, alizarin-doped zinc oxide is separated by vacuum filtration and vacuum-dried at 60° C. As a result, alizarin-doped zinc oxide is obtained.

Sixty parts of the alizarin-doped zinc oxide, 13.5 parts of a curing agent (blocked isocyanate, Sumidur 3175 produced by Sumitomo Bayer Urethane Co., Ltd.), 15 parts of a butyral resin (S-LEC BM-1 produced by Sekisui Chemical Co., Ltd.), and 85 parts of methyl ethyl ketone are mixed to obtain a mixed solution. Thirty eight parts of this mixed solution and 25 parts of methyl ethyl ketone are mixed, and the resulting mixture is dispersed for 2 hours in a sand mill using 1 mm ϕ glass beads to obtain a dispersion.

To the obtained dispersion, 0.005 parts of dioctyltin dilaurate serving as a catalyst and 45 parts of silicone resin particles (Tospearl 145 produced by Momentive Performance Materials Japan LLC) are added to obtain an undercoat-layer-forming solution. The solution is applied to an aluminum substrate having a diameter of 47 mm, a length of 357 mm, and a thickness of 1 mm by a dip coating method, and dried and cured at 170° C. for 30 minutes, so as to obtain an undercoat layer having a thickness of 25 μm.

Formation of Charge Generating Layer

Next, 1 part of hydroxygallium phthalocyanine having intense diffraction peaks at Bragg's angles (2θ±0.2°) of 7.5°, 9.9°, 12.5°, 16.3°, 18.6°, 25.1°, and 28.3° in an X-ray diffraction spectrum, 1 part of polyvinyl butyral (S-LEC BM-S produced by Sekisui Chemical Co., Ltd.), and 80 parts of n-butyl acetate are mixed, and the resulting mixture is dispersed with glass beads in a paint shaker for 1 hour to prepare a charge-generating-layer-forming solution. The obtained solution is applied to the undercoat layer on the conductive support by dip-coating, and heated at 100° C. for 10 minutes to form a charge generating layer having a thickness of 0.15 μm.

Formation of Charge Transporting Layer

The PTFE composition L-A is applied to the charge generating layer by dip-coating, and heated at 130° C. for 45 to prepare a charge transporting layer having a thickness of 13 μm.

A photoreceptor is prepared through the steps described above.

Evaluation of Electrophotographic Photoreceptor A

The following evaluations are conducted by using the obtained photoreceptor.

Visual Evaluation

The surface of the obtained photoreceptor (surface of the charge transporting layer) is observed with naked eye.

A: No streaks are observed.

B: Vague streaks are observed.

C: Clear streaks are observed.

Image Quality Evaluation

The obtained photoreceptors is loaded to an image forming apparatus "ApeosPort C4300" (produced by Fuji Xerox Co., Ltd.). A 5% halftone image is output on 100 sheets of A4 paper. The image on the first sheet and on the 100th sheet is observed, and image defects are evaluated. The evaluation standard is as follows:

A: No image defects are observed.

B: Slight image defects are observed under a magnifying glass (acceptable level).

C: Image defects are visible with naked eye.

D: Clear streak-like image defects are observed.

Example 2

Preparation of PTFE Particles B

As the PTFE particles, a PTFE particle mixture prepared by mixing Lubron L-5 (produced by Daikin Industries, Ltd., specific surface area: 10 $m^2/g$, apparent density: 0.40 g/ml (JIS K 6891 (1995)), melting temperature: 328° C. (JIS K 6891 (1995))) and Lubron L-2 (produced by Daikin Industries, Ltd.) at a mass ratio (L-5:L-2) of 1:1 is used. This PTFE particle mixture is washed and then treated with a fluorine-containing dispersant as in Example 1 to prepare dispersant-attached PTFE particles B.

Preparation of PTFE Composition L-B

A PTFE composition L-B is prepared as in Example 1 except that the dispersant-attached PTFE particles A are changed to the dispersant-attached PTFE particles B.

Evaluation of PTFE Composition L-B

Evaluation is conducted as in Example 1 except that the PTFE composition L-A is changed to the PTFE composition L-B. The results are indicated in Table 1.

Preparation and Evaluation of PTFE Layer-Shaped Article F-B

Preparation and evaluation of a PTFE layer-shaped article F-B are conducted as in Example 1 except that the PTFE composition L-A is changed to the PTFE composition L-B. The results are indicated in Table 1.

Measurement of Particle Diameter

The obtained PTFE layer-shaped article F-B is measured as in Example 1. The results are indicated in Table 1.

Preparation of Electrophotographic Photoreceptor B

An electrophotographic photoreceptor B is prepared as in Example 1 except that the PTFE composition L-A is changed to the PTFE composition L-B.

Evaluation of Electrophotographic Photoreceptor B

The obtained electrophotographic photoreceptor B is evaluated as in Example 1. The results are indicated in Table 1.

Example 3

Dispersant-attached PTFE particles C are obtained as in Example 2 except that, in preparing the dispersant-attached PTFE particles B in Example 2, the mass ratio (L-5:L-2) of Lubron L-5 to Lubron L-2 is changed to 1:3.

Subsequently, preparation and evaluation of a PTFE composition L-C, preparation and evaluation of a PTFE layer-shaped article F-C, measurement of the particle diameter, and preparation and evaluation of an electrophotographic photoreceptor C are conducted as in Example 1 except that the dispersant-attached PTFE particles C are used instead of the dispersant-attached PTFE particles A. The results are indicated in Table 1.

Example 4

Dispersant-attached PTFE particles D are obtained as in Example 2 except that, in preparing the dispersant-attached PTFE particles B in Example 2, the mass ratio (L-5:L-2) of Lubron L-5 to Lubron L-2 is changed to 2:1.

Subsequently, preparation and evaluation of a PTFE composition L-D, preparation and evaluation of a PTFE layer-shaped article F-D, measurement of the particle diameter, and preparation and evaluation of an electrophotographic photoreceptor D are conducted as in Example 1 except that the dispersant-attached PTFE particles D are used instead of the dispersant-attached PTFE particles A. The results are indicated in Table 1.

Comparative Example 1

Preparation of PTFE Particles E

As the PTFE particles, Lubron L-5 (produced by Daikin Industries, Ltd., specific surface area: 10 $m^2/g$, apparent density: 0.40 g/ml (JIS K 6891 (1995)), melting temperature: 328° C. (JIS K 6891 (1995))) is used. These PTFE particles are treated with a fluorine-containing dispersant without washing so as to form dispersant-attached PTFE particles E.

Specifically, 15 parts by mass of PTFE particles are taken, 1.5 parts of GF400 (produced by Toagosei Co, Ltd., a surfactant in which at least a methacrylate having a fluorinated alkyl group is used as the polymerization component) is added thereto as a fluorine-containing dispersant, and then tetrahydrofuran is added so that the amount of the liquid is 415 parts by mass. After the resulting mixture is dispersed in a high-pressure homogenizer, the solvent is distilled away at a reduced pressure. Then, the dried particles are pulverized in a mortar. The resulting particles are assumed to be dispersant-attached PTFE particles E.

Subsequently, preparation and evaluation of a PTFE composition L-E, preparation and evaluation of a PTFE layer-shaped article F-E, measurement of the particle diameter, and preparation and evaluation of an electrophotographic photoreceptor E are conducted as in Example 1 except that the dispersant-attached PTFE particles E are used instead of the dispersant-attached PTFE particles A. The results are indicated in Table 1.

Example 5

Preparation and Evaluation of Powder Coating Material

A powder coating material is prepared as follows by using the dispersant-attached PTFE particles A of Example 1.

Preparation of Polyester Resin-Curing Agent Composite Dispersion (E1)

While a 3 L jacketed reactor (BJ-30N produced by TOKYO RIKAKIKAI CO, LTD.) equipped with a condenser, a thermometer, a water dropper, and an anchor paddle is maintained at 40° C. by using a water-circulation-type constant temperature vessel, a mixed solvent containing 180 parts of ethyl acetate and 80 parts of isopropyl alcohol is injected into the reactor, and then the following composition is injected thereto.

- Polyester resin (PES1) [polycondensation product of terephthalic acid/ethylene glycol/neopentyl glycol/trimethylolpropane (molar ratio=100/60/38/2 (mol %), glass transition temperature=62° C., acid value (Av)=12 mgKOH/g, hydroxyl value (OHv)=55 mgKOH/g, weight-average molecular weight (Mw)=12,000, number-average molecular weight (Mn)=4,000]: 240 parts
- Blocked isocyanate curing agent VESTAGON B 1530 (produced by EVONIK industries): 60 parts
- Benzoin: 1.5 parts
- Acryl oligomer (Acronal 4 F produced by BASF): 3 parts After the injection, stirring is performed by using a three-one motor at 150 rpm, and an oil phase is obtained by dissolution. To this oil phase under stirring, a mixture of 1 part of a 10 mass % aqueous ammonia solution and 47 parts of a 5 mass % aqueous sodium hydroxide solution is added dropwise for 5 minutes, followed, by mixing for 10 minutes, and then 900 parts of ion exchange water is added thereto dropwise at a rate of 5 parts per minute so as to induce phase inversion, and obtain an emulsion.

Into a 2 L round-bottomed flask, 800 of the obtained emulsion and 700 parts of ion exchange water are placed, and the flask is set onto an evaporator (produced by TOKYO RIKAKIKAI CO, LTD.) connected to a vacuum control unit through a trap ball. The round-bottomed flask is heated in a 60° C. hot water bath while being rotated, and the solvent is removed by reducing the pressure to 7 kPa with careful attention to bumping. The pressure is returned to normal (1 atm) when the amount of the recovered solvent reaches 1100 parts, and the round-bottomed flask is cooled with water to obtain a dispersion. The obtained dispersion is free of solvent odor. The volume-average particle diameter of the resin particles in the dispersion is 145 nm. Subsequently, an anionic surfactant (Dowfax 2A1 produced by Dow Chemical, active component content: 45 mass %) is added thereto so that the amount of the active component is 2 mass % relative to the resin content in the dispersion, and, to the resulting mixture, ion exchange water is added so that the solid concentration is adjusted to 25 mass %. The resulting product is assumed to be a polyester resin-curing agent composite dispersion (E1).

Preparation of White Pigment Dispersion (W1)

- Titanium oxide (A-220 produced by ISHIHARA SANGYO KAISHA, LTD.): 100 parts
- Anionic surfactant (NEOGEN RK produced by DKS Co., Ltd.): 15 parts
- Ion exchange water: 400 parts
- 0.3 mol/l nitric acid: 4 parts The above-described ingredients are mixed and dissolved, and the resulting mixture is dispersed for 3 hours by using a high-pressure impact disperser, Ultimaizer (HJP30006 produced by SUGINO MACHINE LIMITED) to prepare a white pigment dispersion containing dispersed titanium oxide. The volume-average particle diameter of the titanium oxide in the pigment dispersion measured with a laser diffraction particle size analyzer is 0.28 μm, and the solid content ratio in the white pigment dispersion is 25%.

Preparation of White Powder Particles (PC1)

- Polyester resin-curing agent composite dispersion (E1): 180 parts (solid content: 45 parts)
- White pigment dispersion (W1): 160 parts (solid content: 40 parts)
- Ion exchange water: 200 parts The above-described ingredients are mixed and dispersed in a round stainless-steel flask by using a homogenizer (ULTRA-TURRAX T50 produced by IKA Japan). Then the pH is adjusted to 3.5 by using a 1.0 mass % aqueous nitric acid solution. Then 0.50 parts of a 10 mass % aqueous polyaluminum chloride solution is added thereto, and the dispersion operation is continued by using ULTRA-TURRAX.

A stirrer and a mantle heater are installed, and while adjusting the number of rotations of the stirring so that the slurry is thoroughly stirred, the temperature is increased to 50° C., 50° C. is held for 15 minutes, and then the particle diameters of the agglomerated particles are measured with a Coulter counter [TA-II] (aperture diameter: 50 μm, produced by Beckman Coulter Inc.). When the volume-average particle diameter reaches 5.5 μm, 60 parts of the polyester resin-curing agent composite dispersion (E1) is slowly injected as a shell (shell injection).

The mixture is retained for 30 minutes after the injection, and the pH is adjusted to 7.0 with a 5% aqueous sodium hydroxide solution. Then, the temperature is increased to 85° C., and held thereat for 2 hours.

Upon completion of the reaction, the solution inside the flask is cooled and filtered to obtain a solid component. Next, the solid component is washed with ion exchange water, and solid-liquid separation is performed by Nutsche filtration under reduced pressure to again obtain a solid component.

This solid component is re-dispersed in 3 L of 40° C. ion exchange water, and washed by stirring for 15 minutes at 300 rpm. This washing operation is performed five times, and a solid component obtained by solid-liquid separation by Nutsche filtration under reduced pressure is vacuum dried for 12 hours. Core-shell-type white powder particles (PC1) are obtained as a result.

The particle diameter of the white powder particles (PC1) is measured. The volume-average particle diameter D50v is 6.8 μm, the volume particle size distribution index GSDv is 1.24, and the average circularity is 0.97.

Preparation of White Powder Coating Material

In a Henschel mixer, 100 parts of the white powder particles (PC1), 0.6 parts of silica particles "RX200 (produced by Nippon Aerosil Co., Ltd.)" serving as an external additive, and 3 parts of the dispersant-attached PTFE particles A serving as an external additive are mixed at a circumferential velocity of 32 m/s for 10 minutes, and then coarse particles are removed with a 45 μm sieve to obtain a white powder coating material.

Evaluation

The following evaluation is conducted by using the obtained white powder coating material.

The powder coating material is loaded into a corona gun XR4-110C produced by ASAHI SUNAC CORPORATION.

The corona gun XR4-110C produced by ASAHI SUNAC CORPORATION is caused to slide in vertical and horizontal directions at a distance 30 cm away from the front surface of a mirror-finished 30 cm×30 cm rectangular aluminum test panel (article to be coated) while spraying the powder coating material to cause the powder coating material to electrostatically attach to the panel. A deposited layer is obtained as a result. The application voltage of the corona gun is set to 80 kV, the input air pressure is set to 0.55 MPa, and the discharge amount is set to 200 g/minute. Painting is performed four times by changing the amount of the powder coating material to be deposited on the panel to 50 g/m$^2$, 90 g/m$^2$, 180 g/m$^2$, and 220 g/m$^2$.

Subsequently, the panels are put in a high-temperature chamber set at 180° C. and heated (baked) therein for 30 minutes.

The obtained coating films are evaluated by tactile examination and visual observation. The evaluation standard is as follows:

A: No defects are found in tactile examination or visual observation.

B: A slight degree of non-uniformity is found in visual observation (acceptable level).

C: Protrusions are found in tactile examination (acceptable level).

D: Non-uniformity is found in visual observation, and protrusions are found in tactile examination.

Examples 6 to 8 and Comparative Example 2

Preparation and Evaluation of Powder Coating Material

Powder coating materials are prepared and evaluated as in Example 5 except that the dispersant-attached PTFE particles B to E of Examples 2 to 4 and Comparative Example 1 are used as an external additive instead of the dispersant-attached PTFE particles A.

These examples are summarized in Tables 1 and 2.

TABLE 1

| | | Example 1 | Example 2 | Example 3 | Example 4 | Comparative Example 1 |
|---|---|---|---|---|---|---|
| Dispersant-attached PTFE particles | Name | PTFE Particles A | PTFE Particles B | PTFE Particles C | PTFE Particles D | PTFE Particles E |
| | $[D_{50} - D_{10}]$ [nm] | 83 | 50 | 70 | 58 | 25 |
| | $D_S$ [nm] | 156 | 164 | 150 | 160 | 177 |
| | Average primary particle diameter [μm] | 0.23 | 0.20 | 0.21 | 0.22 | 0.20 |
| PTFE composition | Name | PTFE composition L-A | PTFE composition L-B | PTFE composition L-C | PTFE composition L-D | PTFE composition L-E |
| | (Evaluation) Average particle diameter [μm] | 0.22 | 0.3 | 0.22 | 0.25 | 0.40 |
| PTFE layer-shaped article | Name | PTFE layer-shaped article F-A | PTFE layer-shaped article F-B | PTFE layer-shaped article F-C | PTFE layer-shaped article F-D | PTFE layer-shaped article F-E |
| | (Evaluation) Average particle diameter [μm] | 0.23 | 0.35 | 0.23 | 0.27 | 0.70 |

TABLE 1-continued

| | | Example 1 | Example 2 | Example 3 | Example 4 | Comparative Example 1 |
|---|---|---|---|---|---|---|
| Photoreceptor | Name | Photoreceptor A | Photoreceptor B | Photoreceptor C | Photoreceptor D | Photoreceptor E |
| | (Evaluation) Visual observation | A | B | A | A | C |
| | (Evaluation) Image on 1st sheet | A | B | A | A | C |
| | (Evaluation) Image on 100th sheet | A | B | A | A | D |

TABLE 2

| | Example 5 | Example 6 | Example 7 | Example 8 | Comparative Example 2 |
|---|---|---|---|---|---|
| Name | PTFE Particles A | PTFE Particles B | PTFE Particles C | PTFE Particles D | PTFE Particles E |
| Coating film evaluation | A | B | A | A | D |

The results described above indicate that satisfactory results are obtained for the evaluations of the photoreceptors and the powder coating materials of Examples compared to Comparative Examples.

This indicates that the dispersant-attached PTFE particles of this exemplary embodiment exhibit excellent dispersibility even when the state of the components mixed is changed.

What is claimed is:

1. A dispersant-attached polytetrafluoroethylene particle comprising:

a polytetrafluoroethylene particle; and a dispersant that contains a fluorine atom and is attached to a surface of the polytetrafluoroethylene particle, wherein the dispersant-attached polytetrafluoroethylene particle has a particle size distribution index [$D_{50}$-$D_{10}$] of 50 nm or more, and the dispersant-attached polytetrafluoroethylene particle has a particle size distribution index [D5] of 50 nm or more and 300 nm or less.

2. The dispersant-attached polytetrafluoroethylene particle according to claim 1, wherein the particle size distribution index [$D_{50}$-$D_{10}$] is 70 nm or more.

3. The dispersant-attached polytetrafluoroethylene particle according to claim 1, wherein the particle size distribution index [$D_{50}$-$D_{10}$] is 200 nm or less.

4. The dispersant-attached polytetrafluoroethylene particle according to claim 2, wherein the particle size distribution index [$D_{50}$-$D_{10}$] is 100 nm or less.

5. The dispersant-attached polytetrafluoroethylene particle according to claim 1, wherein the dispersant that contains a fluorine atom is a fluorinated alkyl group-containing polymer obtained by homopolymerization or copolymerization of a polymerizable compound having a fluorinated alkyl group.

6. The dispersant-attached polytetrafluoroethylene particle according to claim 5, wherein the fluorinated alkyl group-containing polymer is a fluorinated alkyl group-containing polymer having a structural unit represented by general formula (FA) below, or a fluorinated alkyl group-containing polymer having a structural unit represented by general formula (FA) below and a structural unit represented by general formula (FB) below:

(FA)

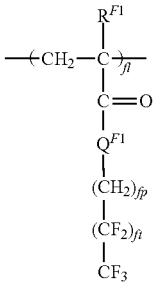

(FB)

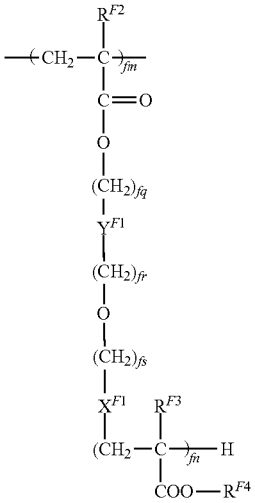

where, in general formulae (FA) and (FB), $R^{F1}$, $R^{F2}$, $R^{F3}$, and $R^{F4}$ each independently represent a hydrogen atom or an alkyl group, $X^{F1}$ represents an alkylene chain, a halogen-substituted alkylene chain, —S—, —O—, —NH—, or a single bond, $Y^{F1}$ represents an alkylene chain, a halogen-substituted alkylene chain, —($C_{fx}H_{2fx-1}$(OH))—, or a single bond, $Q^{F1}$ represents —O— or —NH—, fl, fm, and fn each independently represent an integer of 1 or more, fp, fq, fr, and fs each independently represent 0 or an integer of 1 or more, ft represents an integer of 1 or more and 7 or less, and fx represents an integer of 1 or more.

7. The dispersant-attached polytetrafluoroethylene particle according to claim 1, wherein an amount of the dispersant that contains a fluorine atom is 0.5 mass % or more and 10 mass % or less relative to the polytetrafluoroethylene particle.

8. The dispersant-attached polytetrafluoroethylene particle according to claim 7, wherein the amount of the dispersant that contains a fluorine atom is 1 mass % or more and 10 mass % or less relative to the polytetrafluoroethylene particle.

9. A composition comprising the dispersant-attached polytetrafluoroethylene particle according to claim 1.

10. The composition according to claim 9, wherein the composition is liquid or solid.

11. A layer-shaped article comprising the dispersant-attached polytetrafluoroethylene particle according to claim 1.

12. An electrophotographic photoreceptor comprising:

a conductive substrate; and a photosensitive layer on the conductive substrate, wherein the electrophotographic photoreceptor has an outermost surface layer formed of the layer-shaped article according to claim 11.

13. A process cartridge comprising the electrophotographic photoreceptor according claim 12, wherein the process cartridge is detachably attachable to an image forming apparatus.

14. An image forming apparatus comprising:

the electrophotographic photoreceptor according to claim 12;

a charging unit that charges a surface of the electrophotographic photoreceptor;

an electrostatic image-forming unit that forms an electrostatic latent image on the charged surface of the electrophotographic photoreceptor;

a developing unit that develops the electrostatic latent image on the surface of the electrophotographic photoreceptor by using a developer containing a toner so as to form a toner image; and a transfer unit that transfers the toner image onto a surface of a recording medium.

15. The dispersant-attached polytetrafluoroethylene particle according to claim 1, wherein the dispersant-attached polytetrafluoroethylene particle has the average primary particle diameter of 0.15 μm or more and 0.5 μm or less.

16. The dispersant-attached polytetrafluoroethylene particle according to claim 1, wherein the particle size distribution index [$D_5$] of the dispersant-attached polytetrafluoroethylene particle is 50 nm or more and 250 nm or less.

17. The dispersant-attached polytetrafluoroethylene particle according to claim 1, wherein the particle size distribution index [$D_5$] of the dispersant-attached polytetrafluoroethylene particle is 100 nm or more and 250 nm or less.

18. The dispersant-attached polytetrafluoroethylene particle according to claim 1, wherein the particle size distribution index [$D_5$] of the dispersant-attached polytetrafluoroethylene particle is 150 nm or more and 200 nm or less.

19. The dispersant-attached polytetrafluoroethylene particle according to claim 1, wherein the particle size distribution index [$D_5$] of the dispersant-attached polytetrafluoroethylene particle is 50 nm or more and 177 nm or less.

20. The dispersant-attached polytetrafluoroethylene particle according to claim 1, wherein the dispersant-attached polytetrafluoroethylene particle has the average primary particle diameter of 0.22 μm or more and 0.5 μm or less.

* * * * *